US007444113B2

(12) United States Patent
Kobayashi

(10) Patent No.: US 7,444,113 B2
(45) Date of Patent: Oct. 28, 2008

(54) IMAGE FORMATION DEVICE

(75) Inventor: Toshimitsu Kobayashi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 274 days.

(21) Appl. No.: 11/281,370

(22) Filed: Nov. 18, 2005

(65) Prior Publication Data

US 2006/0291931 A1 Dec. 28, 2006

(30) Foreign Application Priority Data

Jun. 24, 2005 (JP) ..... 2005-184773

(51) Int. Cl.
*G03G 15/00* (2006.01)

(52) U.S. Cl. ..... 399/392; 399/369; 399/391; 399/393

(58) Field of Classification Search ..... 399/369, 399/392, 393, 391
See application file for complete search history.

(56) References Cited

U.S. PATENT DOCUMENTS

2004/0190934 A1* 9/2004 Okabe ..... 399/111

FOREIGN PATENT DOCUMENTS

JP 2001-225973 A 8/2001
JP 2003-241616 A 8/2003

* cited by examiner

*Primary Examiner*—Ren Yan
*Assistant Examiner*—Andy L Pham
(74) *Attorney, Agent, or Firm*—Sughrue Mion, PLLC

(57) ABSTRACT

An image formation device is equipped with a withdrawably provided paper supply cassette. A display portion and a cover-like opening/closing portion are also provided. The display portion is formed at an upper portion of a withdrawal side of the paper supply cassette and shows information relating to the paper supply cassette. The opening/closing portion structures a portion of a side wall of the device at an upper side relative to the paper supply cassette, at the withdrawal side of the paper supply cassette, and includes an openably/closeably attached manual tray. A masking portion, which masks at least some of the display portion when the manual tray is open, is also provided.

15 Claims, 8 Drawing Sheets

IMAGE FORMATION DEVICE

CROSS-REFERENCE TO RELATED APPLICATION

This application claims priority under 35 USC 119 from Japanese Patent Application No. 2005-184773, the disclosure of which is incorporated by reference herein.

BACKGROUND OF THE INVENTION

1. Field of the Invention

The present invention relates to an image formation device which is equipped with a paper supply cassette which is provided to be withdrawable.

2. Description of the Related Art

For image formation devices, various techniques have being devised to form structures which are capable of utilizing a number of varieties of sheets (paper) and which are reduced in size.

For example, in an image formation device disclosed in Japanese Patent Application Laid-Open (JP-A) No. 2001-225973, a cassette is withdrawably mounted at a main body of the device, and a second sheet supply apparatus is provided at a withdrawal side end portion of the cassette. This second sheet supply apparatus features a second sheet accommodation portion, separate from a sheet accommodation portion of the cassette, and feeding section, which feeds the sheets accommodated in the second sheet accommodation portion to an image formation section.

Further, in JP-A No. 2003-241616, an image formation device has been disclosed with a structure in which, in a state in which a front cover is open, an upper face of a cassette is exposed.

Anyway, at the cassette of the image formation device disclosed in JP-A No. 2001-225973, it has often been the case that display of a guide to operations of the cassette or the like is implemented at an upper face of the withdrawal side of the cassette. Meanwhile, at the second sheet accommodation portion, a tray at which paper is placed is often combined with an external cover of the image formation device. Hence, if small quantities of sheets are to be accommodated at the second sheet accommodation portion, the tray combined with the external cover can be structured to be thin and simple. Thus, when this tray/cover is open, the upper face of the withdrawal side of the cassette is not exposed as in JP-A No. 2003-241616.

However, when an increase in an amount of sheets to be accommodated at the second sheet accommodation portion is considered, a tray which also functions as an external cover is not sufficient. It is then necessary for a tray adequate for supporting the sheets to be structured at an inner side of the external cover, and the external cover and tray inevitably have increased thickness. Hence, when the external cover and tray which are thick are opened, a display portion at the upper face of the cassette, such as a guide to operations or the like, enters an operator's field of view, which may cause confusion to the operator.

SUMMARY OF THE INVENTION

In consideration of the circumstances described above, the present invention is to provide an image formation device which avoids confusion of an operator at a time of use of a manual tray.

That is, an image formation device of a first aspect of the present invention is an image formation device which is equipped with a withdrawably provided paper supply cassette and includes: a display portion formed at an upper portion of a withdrawal side of the paper supply cassette, the display portion displaying information relating to the paper supply cassette; and a cover-form opening/closing portion which structures a portion of a side wall of the device at an upper side relative to the paper supply cassette, at the withdrawal side of the paper supply cassette, and includes an openably and closeably attached manual tray, and the image formation device is provided with a masking portion which masks at least a portion of the display portion when the manual tray has been opened.

Thus, at a time of use of the manual tray, at least a portion of the display portion formed at the paper supply cassette (which is, for example, a display label) will not be seen by an operator. Therefore, it is possible to avoid confusing the operator and to avoid erroneous operations and the like.

BRIEF DESCRIPTION OF THE DRAWINGS

Preferred embodiments of the present invention will be described in detail based on the following figures, wherein.

DETAILED DESCRIPTION OF THE INVENTION

Figure 1:
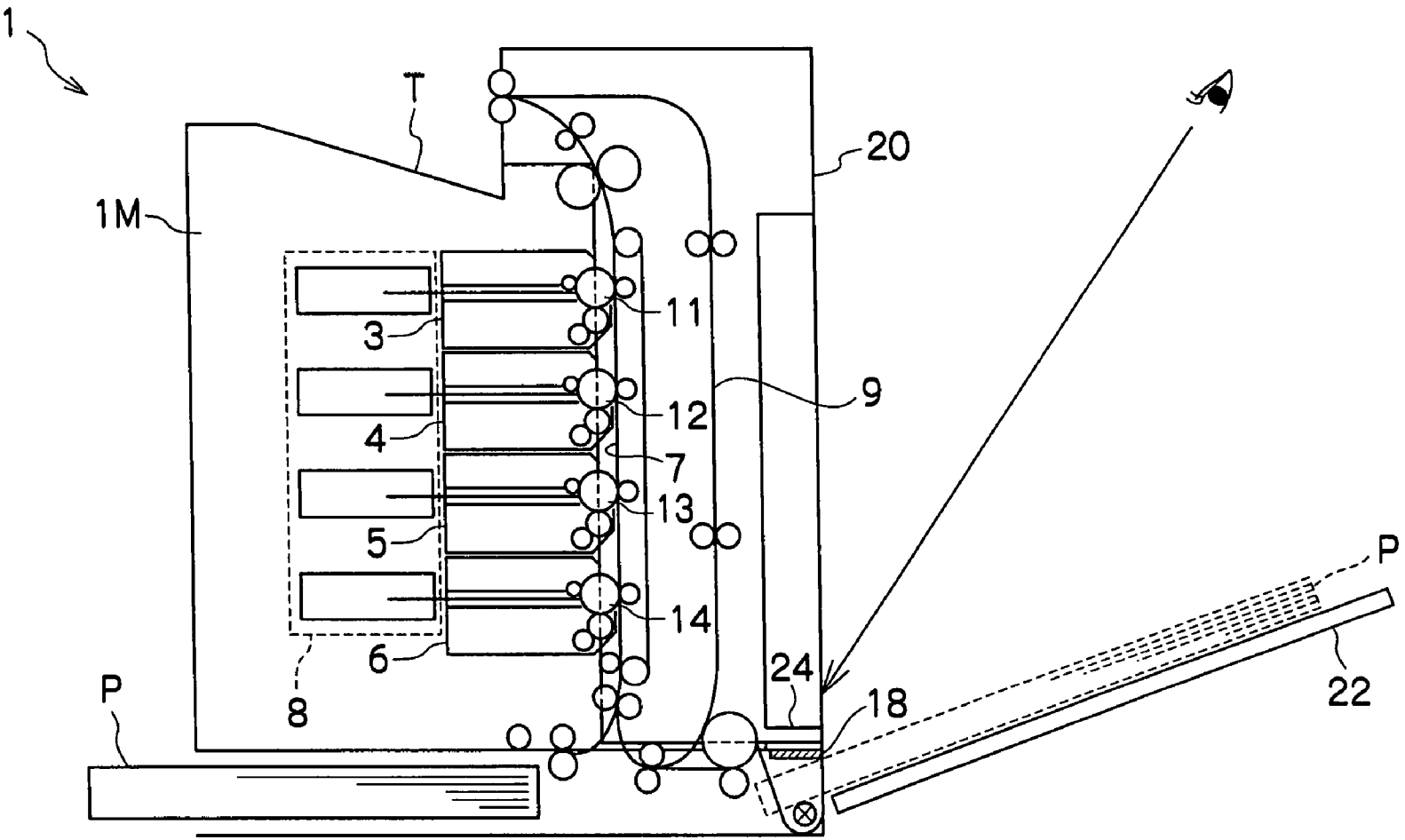
FIG. 1 is a side sectional view of an image formation device relating to a first embodiment, showing structure in a state in which a manual tray is open.

Herebelow, examples of embodiments will be described as embodiments of the present invention. Note that, from the second embodiment onward, structural elements which are the same as structural elements that have been previously described will be assigned the same reference numerals, and descriptions thereof will be omitted.

First Embodiment

Figure 2:
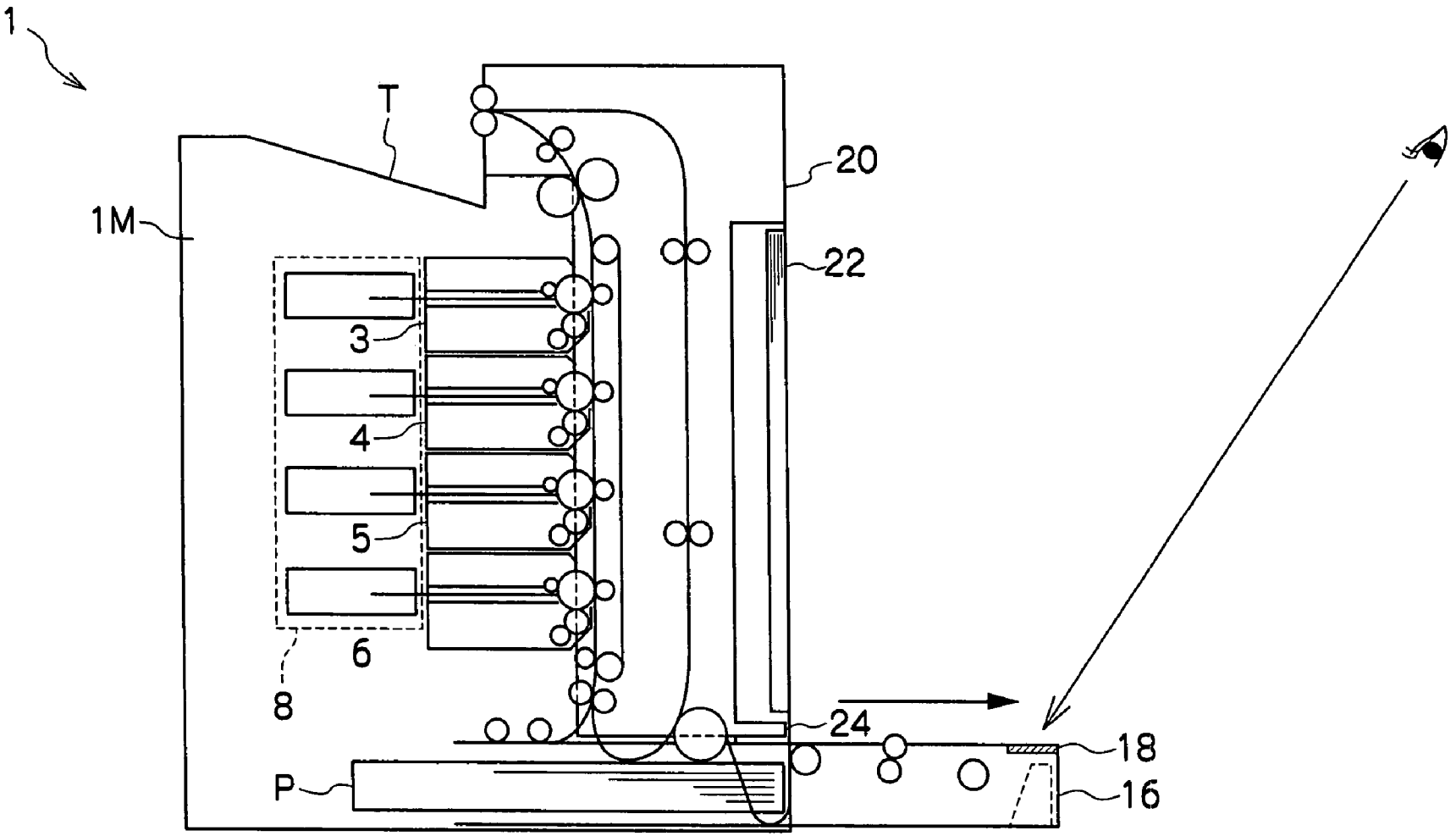
FIG. 2 is a side sectional view of the image formation device relating to the first embodiment, showing structure in a state in which a paper supply cassette has been withdrawn without the manual tray being opened.
Figure 3:
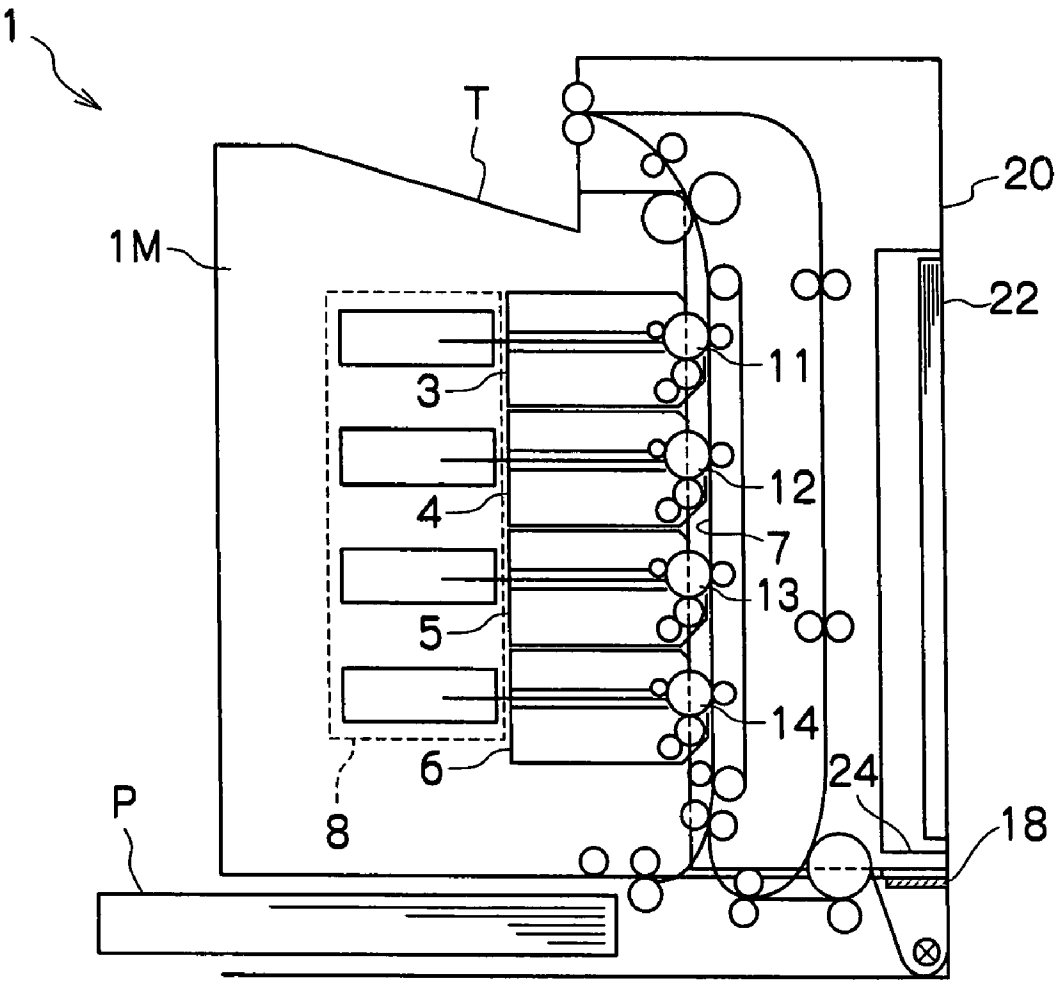
FIG. 3 is a side sectional view of the image formation device relating to the first embodiment, showing structure in a state in which an opening/closing portion is closed (in a state in which the manual tray is closed and the paper supply cassette is accommodated)
Figure 4:
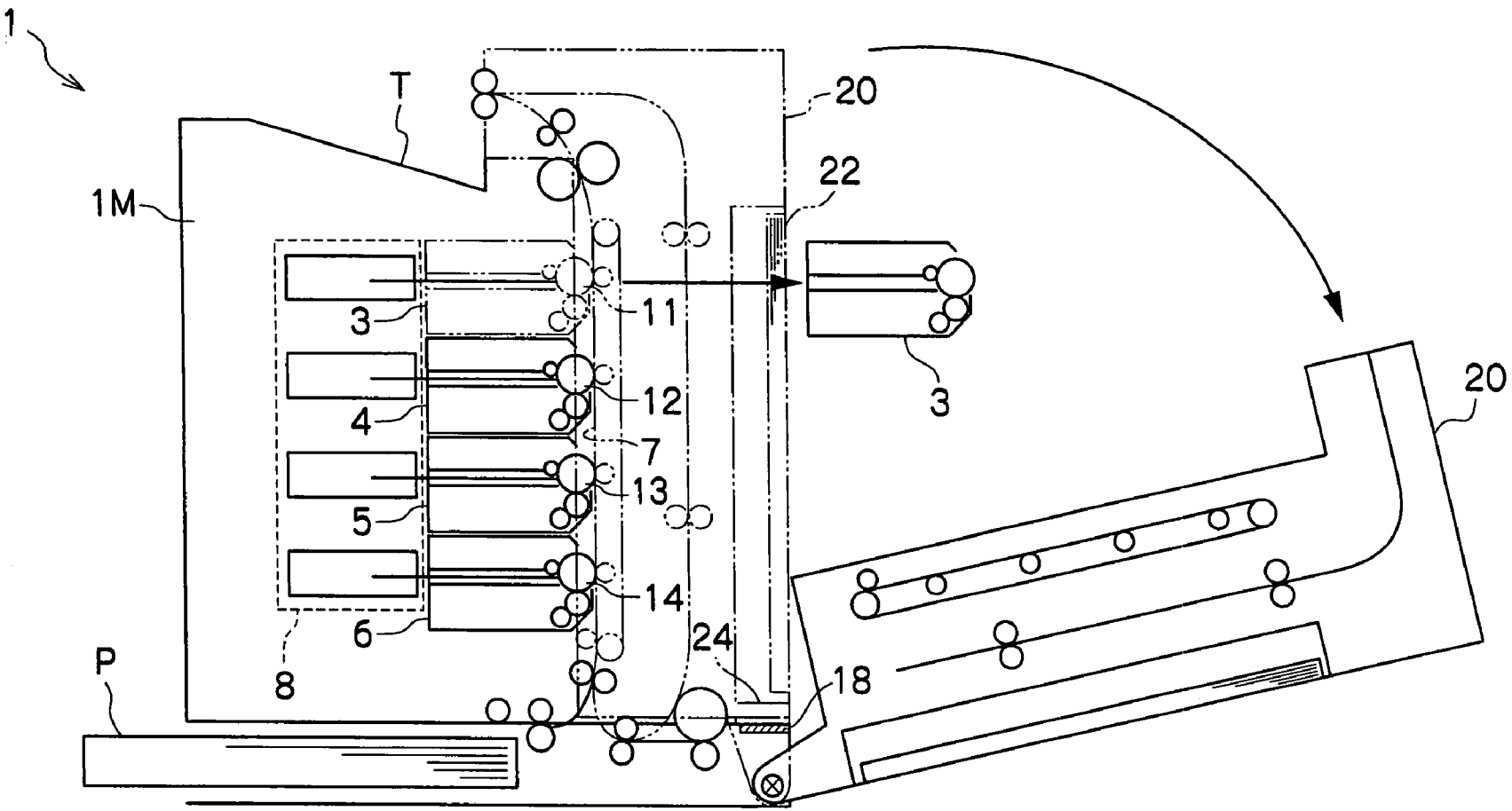
FIG. 4 is a side sectional view of the image formation device relating to the first embodiment, showing structure in a state in which the opening/closing portion is open.

First, a first embodiment will be described. As shown in FIGS. 1 and 2, a printer 1 relating to the first embodiment is a full-color printer. Four process cartridges 3, 4, 5 and 6 and a transfer belt 7 are provided inside a main body 1M of the printer 1. The process cartridges 3, 4, 5 and 6 are arranged in tandem substantially vertically. The transfer belt 7 is arranged along the process cartridges 3, 4, 5 and 6. Structure is formed such that it is possible to open out the transfer belt 7 to form a gap through which the process cartridges 3, 4, 5 and 6 can be removed in a substantially horizontal direction. Photosensitive drums (image-bearing bodies) 11, 12, 13 and 14 are provided at the process cartridges 3, 4, 5 and 6, respectively.

An ROS 8 is also provided at the printer 1. The ROS 8 implements exposure of respective images onto the photosensitive drums 11, 12, 13 and 14. Latent images which have been formed on the photosensitive drums 11, 12, 13 and 14 are respectively developed with toner of the respective colors yellow (Y), magenta (M), black (K) and cyan (C) by the process cartridges 3, 4, 5 and 6. The ROS 8 serving as an exposure apparatus is structured with four semiconductor lasers, which are driven to light on the basis of image data corresponding to the respective colors yellow (Y), magenta (M), black (K) and cyan (C), f-θ lenses and polygonal mirrors for polarizing and scanning the laser lights emitted from the four semiconductor lasers, or alternatively pluralities of reflection mirrors, and so forth.

The printer 1 is also equipped with a paper supply cassette 16 (see FIG. 2), which is provided below the process cartridges and supplies transfer paper P, which serves as a transfer material. A cassette accommodation portion, which withdrawably accommodates the paper supply cassette 16, is formed in the printer main body 1M. A display portion 18, which displays information relating to the paper supply cassette 16, is formed at an upper portion of a withdrawal side of the paper supply cassette 16.

A cover-form opening/closing portion 20 is also provided at the printer 1. The opening/closing portion 20 structures a side wall portion of the device at an upper side relative to the paper supply cassette 16, at the withdrawal side of the paper supply cassette 16 (the right side in FIGS. 1 to 4). This opening/closing portion 20 is provided so as to be able to open and close a side face of the device by turning about an axial support (not shown), which is provided at a lower portion of the cassette accommodation portion. With this structure, the opening/closing portion 20 opens up to put the device into a state in which the photosensitive drums 11, 12, 13 and 14 are exposed and it is possible to perform maintenance to deal with paper jams and the like. Further, the opening/closing portion 20 is equipped with an openable manual tray 22 which supplies paper, passing the paper underneath the display portion 18. Thus, it is possible to supply transfer paper P from outside the printer main body 1M.

Further, a rib 24 is provided at the opening/closing portion 20, so as to mask at least a portion of the display portion 18 (the whole of the display portion 18 in FIG. 1) in the state in which the manual tray 22 has been opened.

In addition to the elements described hereabove, the printer 1 is equipped with: a fixing apparatus (not shown), which applies a fixing process to transfer paper P to which a toner image has been transferred; a conveyance path for duplex printing 9, which conveys transfer paper P, onto one face of which an image has been fixed by the fixing apparatus, to the transfer section a second time, in a state in which the back and front of the paper are exchanged; a control circuit, which controls operations of the printer; a controller, which is formed with an image processing circuit which applies image processing to image signals, and the like; electrical circuits, including a high-voltage power supply circuit and the like; and so forth. Note that, in FIGS. 1 to 4, the letter 'T' indicates an ejection tray, to which the transfer paper P to which images have been transferred is ejected. This ejection tray T is integrally formed at an upper portion of the printer main body 1M.

As has been described above, in the present embodiment, the manual tray 22 is provided so as to be openable/closeable at the cover-form opening/closing portion 20 which structures a portion of the device side wall at the withdrawal side of the paper supply cassette 16. Thus, the printer 1 is formed to be more compact and to have greater ease of use. Moreover, in the state in which the manual tray 22 is open, the display portion 18 which is formed at the upper portion of the withdrawal side of the paper supply cassette 16 is covered by the rib 24, and is not visible to an operator. Thus, it is possible to avoid confusing the operator and to avoid erroneous operations and the like. Further still, because the shielding of the display portion 18 is achieved by the provision of the rib 24, the opening/closing portion 20 and the paper supply cassette 16 can be disposed close together, and there is no need to increase height of the device.

Second Embodiment

Next, a second embodiment will be described. In this embodiment, in comparison with the first embodiment, the display portion 18 displays papers which cannot be set in the paper supply cassette 16.

Hence, an operator will not be confused when setting papers at the manual tray 22 that can be set at the manual tray 22 but should not be set in the paper supply cassette 16 (such as, for example, OHP sheets).

Third Embodiment

Next, a third embodiment will be described. In this embodiment, in comparison with the first embodiment, the display portion 18 shows a procedure for setting paper in the paper supply cassette 16.

Hence, even if the procedure for setting paper at the paper supply cassette 16 is different from a procedure for setting paper at the manual tray 22, an operator will not be confused.

Fourth Embodiment

Next, a fourth embodiment will be described. In this embodiment, in comparison with the first embodiment, the display portion 18 displays an orientation for setting paper in the paper supply cassette 16.

Hence, even if the paper setting orientation at the paper supply cassette 16 is different from an orientation for setting paper at the manual tray 22, an operator will not be confused.

Fifth Embodiment

Figure 5:
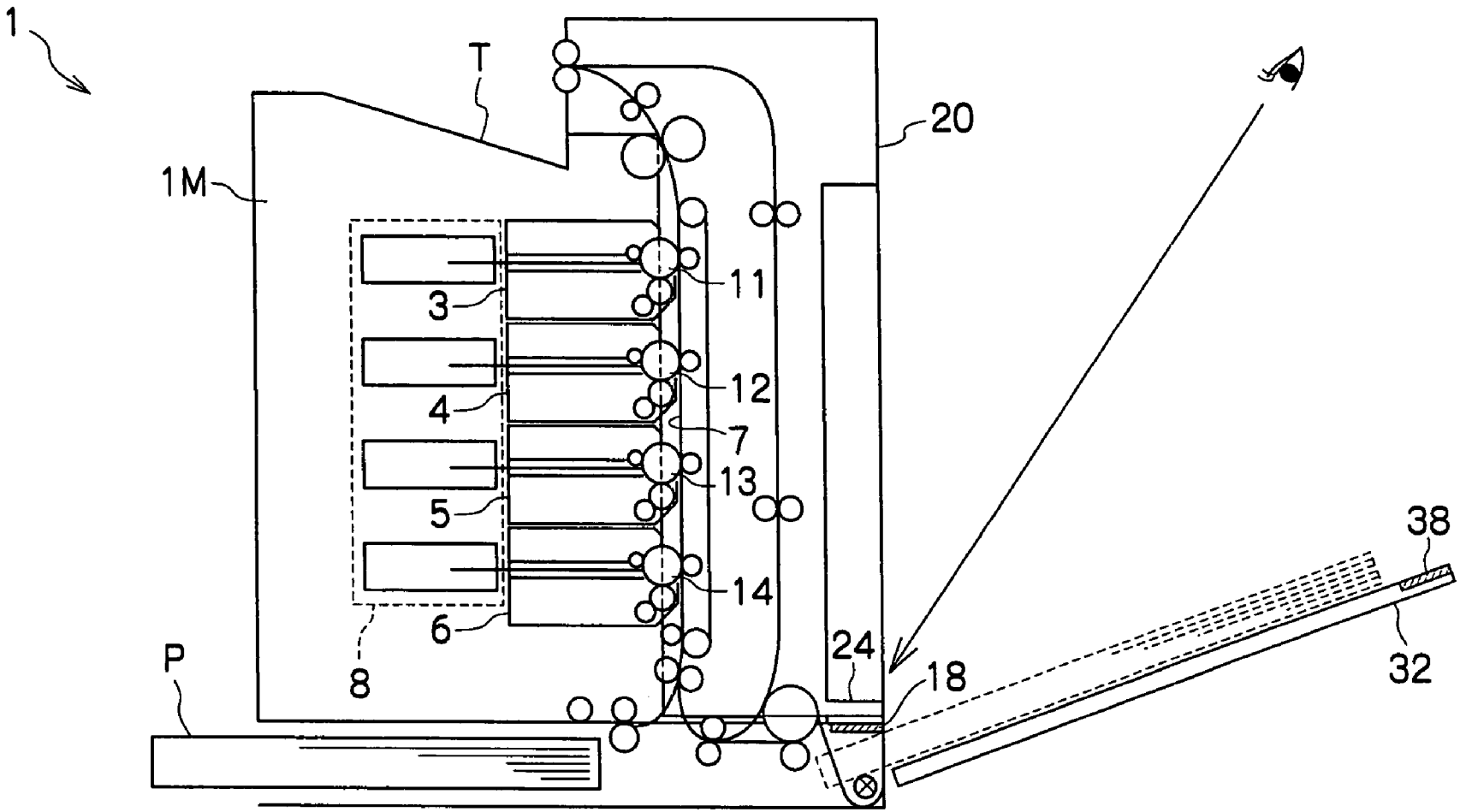
FIG. 5 is a side sectional view of an image formation device relating to a fifth embodiment, showing structure in a state in which a manual tray is open.
Figure 6:
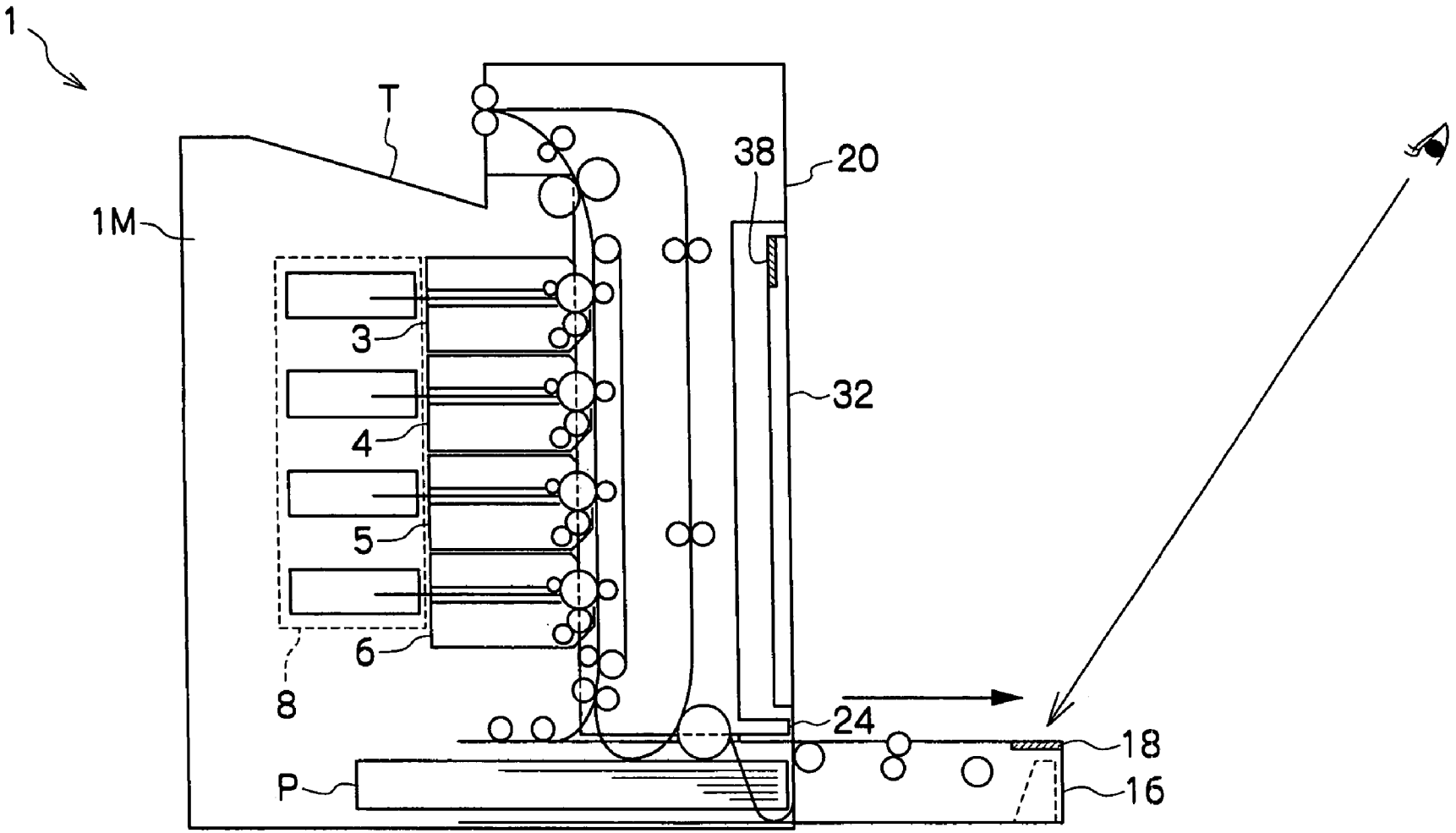
FIG. 6 is a side sectional view of the image formation device relating to the fifth embodiment, showing structure in a state in which a paper supply cassette has been withdrawn without the manual tray being opened.

Next, a fifth embodiment will be described. In this embodiment, as shown in FIGS. 5 and 6, a manual tray 32 is provided instead of the manual tray 22 described for the first embodiment. A manual-use display portion 38 is formed at an inner side of the manual tray 32. When the manual tray 32 has been opened, the manual-use display portion 38 can be seen by an operator.

Hence, at times of manual use, only the manual-use display portion 38 will be in an operator's field of view, and the operator will not be confused.

Sixth Embodiment

Figure 7:
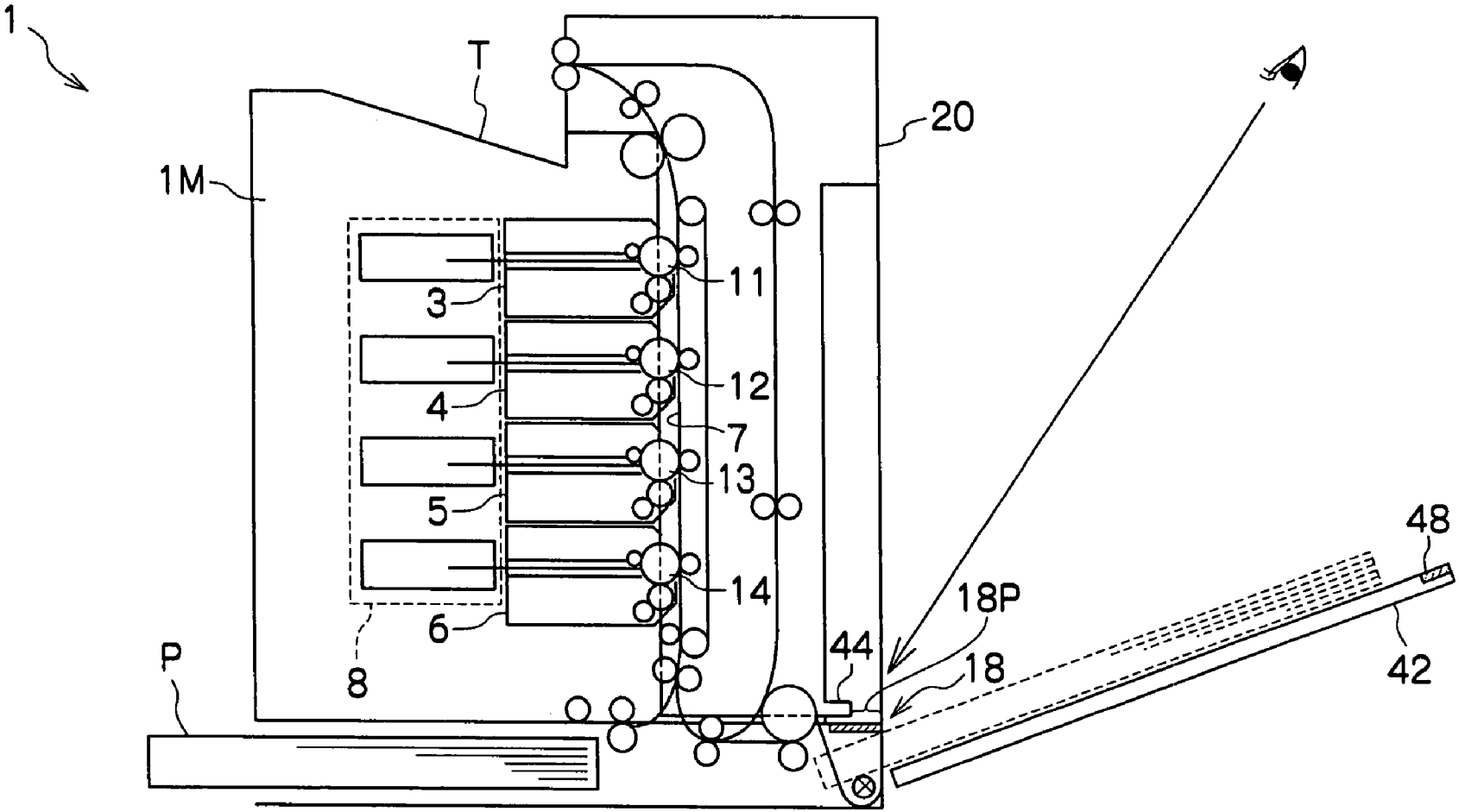
FIG. 7 is a side sectional view of an image formation device relating to a sixth embodiment, showing structure in a state in which a manual tray is open.
Figure 8:
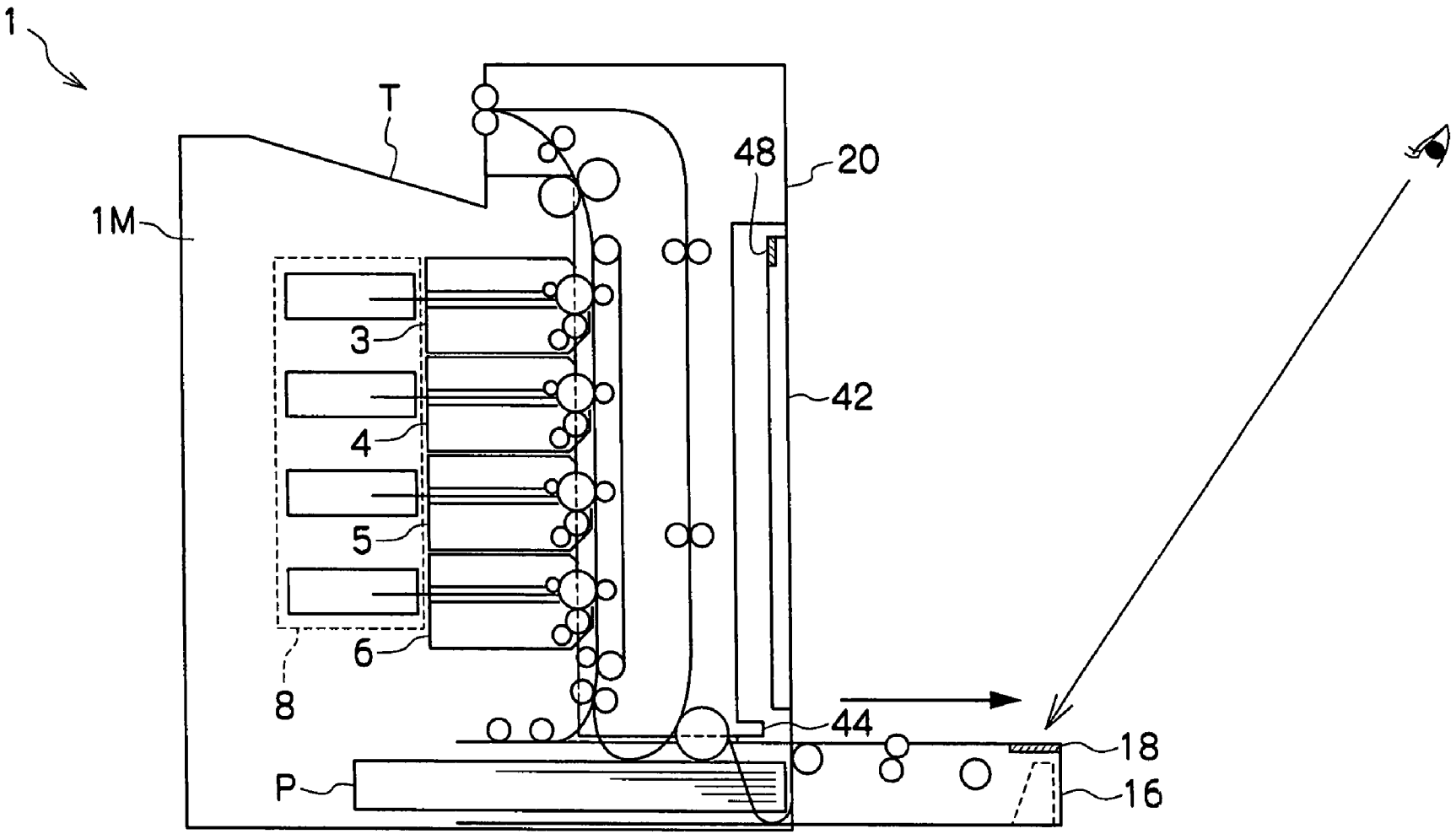
FIG. 8 is a side sectional view of the image formation device relating to the sixth embodiment, showing structure in a state in which a paper supply cassette has been withdrawn without the manual tray being opened.

Next, a sixth embodiment will be described. In this embodiment, as shown in FIGS. 7 and 8, in comparison with the first embodiment, a manual tray 42 is provided instead of the manual tray 22 described for the first embodiment. A manual-use display portion 48 is formed at an inner side of the manual tray 42. When the manual tray 42 has been opened, the manual-use display portion 48 can be seen by an operator. Furthermore, a rib 44 is provided instead of the rib 24 described for the first embodiment, such that, when the manual tray 42 is open, the rib 44 does not mask a display area 18P of the display portion 18 provided at the upper portion of the withdrawal side of the paper supply cassette 16. The display area 18P can be used in combination with the manual-use display portion 48.

With the present embodiment, it is possible to simplify the manual-use display portion 48 (for example, omitting therefrom a symbol prohibiting paper clips).

Hereabove, example embodiments have been given to explain embodiments of the present invention. These embodiments are just examples, and various modifications can be embodied within a scope not departing from the spirit of the present invention. Obviously, the scope of rights to the present invention is not to be limited to the embodiments described above.

That is, an image formation device of a first aspect of the present invention is an image formation device which is equipped with a withdrawably provided paper supply cassette and includes: a display portion formed at an upper portion of a withdrawal side of the paper supply cassette, the display portion displaying information relating to the paper supply cassette; and a cover-form opening/closing portion which structures a portion of a side wall of the device at an upper side relative to the paper supply cassette, at the withdrawal side of the paper supply cassette, and includes an openably and closeably attached manual tray, and the image formation device is provided with a masking portion which masks at least a portion of the display portion when the manual tray has been opened.

Thus, at times of use of the manual tray, because at least part of the display portion formed at the paper supply cassette (for example, a display label) is not visible to an operator, it is possible to avoid confusion of the operator and mistaken operations and the like.

In the image formation device of the first aspect of the present invention, an upper face of the manual tray, at which paper is to be placed, may be disposed lower than the display portion.

Even in a case in which paper supply from the manual tray passes beneath the display portion because the upper face of the manual tray at which paper is to be placed is thus located lower than the display portion, at least part of the display portion—particularly a portion which would lead to misunderstandings, confusion of a user and the like at a time of manual paper supply—is shielded by the masking portion. Therefore, even a device in which height of a paper supply mechanism relating to the manual tray is restrained and the image formation device is reduced in size will be advantageous.

Further, in the image formation device of the first aspect of the present invention, the masking portion may be provided at the opening/closing portion.

Because a screen is thus provided at the opening/closing portion, such that at least part of the display portion will be masked when the manual tray has been opened, it is possible to dispose the opening/closing portion and the paper supply cassette close together, and there is no need to increase height of the device.

Further, the image formation device of the first aspect of the present invention may further include a manual-use display portion, which displays information relating to the manual tray, the manual-use display portion being displayed when the manual tray has been opened, and the opening/closing portion not masking an item of the display portion that is employed for the manual-use display portion.

Accordingly, it is possible to keep the manual-use display portion simple (for example, not providing an additional paper clip prohibition symbol).

Further, in the image formation device of the first aspect of the present invention, the display portion may display at least information relating to paper which is prohibited from being set at the paper supply cassette.

Hence, an operator will not be confused when loading paper at the manual tray which can be loaded at the manual tray but could not be loaded at the paper supply cassette (for example, OHP sheets).

Further, in the image formation device of the first aspect of the present invention, the display portion may display at least information relating to a procedure for setting paper at the paper supply cassette.

Hence, even if a procedure for loading paper in the paper supply cassette is different from a procedure for the manual tray, an operator will not be confused.

Further, in the image formation device of the first aspect of the present invention, the display portion may display at least information relating to an orientation of setting of paper at the paper supply cassette.

Hence, even if an orientation for loading paper in the paper supply cassette is different from an orientation for the manual tray, an operator will not be confused.

Further, in the image formation device of the first aspect of the present invention, the manual-use display portion, which displays information relating to the manual tray, may be provided at the manual tray.

Hence, only the manual-use display portion will enter an operator's field of view at a time of manual use, and the operator will not be confused.

Further, in the image formation device of the first aspect of the present invention, the masking portion may include a rib formed at the opening/closing portion.

Thus, a screen for the display portion can be formed with a simple structure, which will assist a reduction in device height.

With the structures described above, the present invention is capable of achieving the following effects.

Because at least a portion of the display portion formed at the paper supply cassette will not be seen by an operator during use of the manual tray, the image formation device of the first aspect of the present invention is capable of preventing confusion of the operator and erroneous operations and the like.

Further, even when paper supply from the manual tray is passed underneath the display portion, because at least a portion of the display portion—particularly an area which would lead to misunderstanding or confusion of a user during manual paper supply—is shielded by the masking portion, the image formation device of the first aspect of the present invention is favorable even if height of a paper supply mechanism relating to the manual tray is suppressed to reduce size of the image formation device.

Further, in the image formation device of the first aspect of the present invention, when the screen is provided at the opening/closing portion so as to shield the at least a portion of the display portion when the manual tray is open, the opening/closing portion and the paper supply cassette can be disposed close together, and there is no need to increase height of the device.

Further, in the image formation device of the first aspect of the present invention, it is possible to implement a simplification of the manual-use display potion.

Further, at the image formation device of the first aspect of the present invention, an operator will not be confused when setting paper in the manual tray that can be set in the manual tray but could not be set in the paper supply cassette.

Further, at the image formation device of the first aspect of the present invention, an operator will not be confused if a procedure for setting paper in the paper supply cassette is different from that of the manual tray.

Further, at the image formation device of the first aspect of the present invention, an operator will not be confused if an orientation for setting paper in the paper supply cassette is different from that of the manual tray.

Further, at the image formation device of the first aspect of the present invention, because only the manual-use display portion will impinge on an operator's vision at a time of manual use, the operator will not be confused.

Further, at the image formation device of the first aspect of the present invention, the screen of the display portion can be formed with a simple structure, which will assist a reduction in device height.

An image formation device which is equipped with a withdrawably provided paper supply cassette and includes: a display portion formed at an upper portion of a withdrawal side of the paper supply cassette, the display portion displaying information relating to the paper supply cassette; a manual tray which structures a portion of a side wall of the device at an upper side relative to the paper supply cassette, at the withdrawal side of the paper supply cassette, and is openably and closeably attached; and a masking portion, which masks at least a portion of the display portion when the manual tray has been opened.

In the image formation device of the second aspect of the present invention, an upper face of the manual tray, at which paper is to be placed, may be disposed lower than the display portion.

Further, the image formation device of the second aspect of the present invention may further include a manual-use display portion, which displays information relating to the manual tray, the manual-use display portion being displayed when the manual tray has been opened, and the masking portion not masking an item of the display portion that is employed for the manual-use display portion.

Further, in the image formation device of the second aspect of the present invention, the display portion may display at least information relating to paper which is prohibited from being set at the paper supply cassette.

Further, in the image formation device of the second aspect of the present invention, the display portion may display at least information relating to a procedure for setting paper at the paper supply cassette.

Further, in the image formation device of the second aspect of the present invention, the display portion may display at least information relating to an orientation of setting of paper at the paper supply cassette.

Further, in the image formation device of the second aspect of the present invention, the manual-use display portion, which displays information relating to the manual tray, may be provided at the manual tray.

Further, the image formation device of the second aspect of the present invention may further include a cover-form opening/closing portion which structures a portion of the side wall of the device at the upper side relative to the paper supply cassette, at the withdrawal side of the paper supply cassette, the manual tray being openably and closeably attached at the opening/closing portion, and the masking portion including a rib, which rib is formed at the opening/closing portion.

Further still, an image formation apparatus of a third aspect of the present invention is an image formation device which is equipped with a withdrawably provided paper supply cassette and includes: a display portion formed at an upper portion of a withdrawal side of the paper supply cassette, the display portion displaying information relating to the paper supply cassette; a manual tray which structures a portion of a side wall of the device at an upper side relative to the paper supply cassette, at the withdrawal side of the paper supply cassette, and is openably and closeably attached; a masking portion, which masks at least a portion of the display portion when the manual tray has been opened; and a manual-use display portion which is displayed when the manual tray has been opened, the manual-use display portion displaying information relating to the manual tray, wherein the masking portion does not mask an item of the display portion that is employed for the manual-use display portion.

In the image formation device of the third aspect of the present invention, an upper face of the manual tray, at which paper is to be placed, may be disposed lower than the display portion.

Further, in the image formation device of the third aspect of the present invention, the manual-use display portion, which displays information relating to the manual tray, may be provided at the manual tray.

What is claimed is:

1. An image formation device which is equipped with a withdrawably provided paper supply cassette and comprising:

a display portion formed at an upper portion of a withdrawal side of the paper supply cassette, the display portion displaying information relating to the paper supply cassette;

a cover-form opening/closing portion which structures a portion of a side wall of the device at an upper side relative to the paper supply cassette, at the withdrawal side of the paper supply cassette, and includes an openably and closeably attached manual tray, and a masking portion which masks at least a portion of the display portion when the manual tray has been opened;

wherein when the manual tray has been opened, a part of an upper face of the manual tray, at which paper is to be placed, is disposed lower than the display portion.

2. The image formation device of claim 1, wherein the masking portion is provided at the opening/closing portion.

3. The image formation device of claim 1, wherein the display portion displays at least information relating to paper which is prohibited from being set at the paper supply cassette.

4. The image formation device of claim 1, wherein the display portion displays at least information relating to a procedure for setting paper at the paper supply cassette.

5. The image formation device of claim 1, wherein the display portion displays at least information relating to an orientation of setting of paper at the paper supply cassette.

6. The image formation device of claim 1, wherein the masking portion comprises a rib formed at the opening/closing portion.

7. An image formation device which is equipped with a withdrawably provided paper supply cassette and comprising:

a display portion formed at an upper portion of a withdrawal side of the paper supply cassette, the display portion displaying information relating to the paper supply cassette;

a manual tray which structures a portion of a side wall of the device at an upper side relative to the paper supply cassette, at the withdrawal side of the paper supply cassette, and is openably and closeably attached; and a masking portion, which masks at least a portion of the display portion when the manual tray has been opened;

wherein when the manual tray has been opened, a part of an upper face of the manual tray, at which paper is to be placed, is disposed lower than the display portion.

8. The image formation device of claim 7, wherein the display portion displays at least information relating to paper which is prohibited from being set at the paper supply cassette.

9. The image formation device of claim 7, wherein the display portion displays at least information relating to a procedure for setting paper at the paper supply cassette.

10. The image formation device of claim 7, wherein the display portion displays at least information relating to an orientation of setting of paper at the paper supply cassette.

11. The image formation device of claim 7, wherein the manual-use display portion, which displays information relating to the manual tray, is provided at the manual tray.

12. The image formation device of claim 7, further comprising a cover-form opening/closing portion which structures a portion of the side wall of the device at the upper side relative to the paper supply cassette, at the withdrawal side of the paper supply cassette, the manual tray being openably and closeably attached at the opening/closing portion, and the masking portion including a rib, which rib is formed at the opening/closing portion.

13. The image formation device of claim 1, wherein the opening/closing portion is provided so as to be able to open and close a side face of the device by turning about an axial support, which is provided at a lower portion of the cassette accommodating portion.

14. The image formation device of claim 1, wherein the paper supplied from the manual tray is passed underneath the display portion.

15. The image formation device of claim 7, wherein the paper supplied from the manual tray is passed underneath the display portion.

* * * * *